US006595901B2

(12) United States Patent
Reinbold et al.

(10) Patent No.: US 6,595,901 B2
(45) Date of Patent: Jul. 22, 2003

(54) METHOD AND APPARATUS FOR ISOMETRIC EXERCISE

(75) Inventors: Kirk A. Reinbold, Phoenixville, PA (US); Robert J. Goldman, Philadelphia, PA (US)

(73) Assignee: Sensorpad Systems, Inc., Norristown, PA (US)

( * ) Notice: Subject to any disclaimer, the term of this patent is extended or adjusted under 35 U.S.C. 154(b) by 0 days.

(21) Appl. No.: 10/046,474

(22) Filed: Oct. 19, 2001

(65) Prior Publication Data

US 2002/0091039 A1 Jul. 11, 2002

Related U.S. Application Data

(62) Division of application No. 09/589,702, filed on Jun. 8, 2000
(60) Provisional application No. 60/139,118, filed on Jun. 14, 1999.

(51) Int. Cl.[7] ..... A63B 21/002
(52) U.S. Cl. ..... 482/91
(58) Field of Search ..... 482/91, 1–9; 128/25

(56) References Cited

U.S. PATENT DOCUMENTS 4,642,769 A * 2/1987 Petrofsky ..... 364/415
4,702,108 A * 10/1987 Amundsen et al. ..... 73/379
4,825,852 A * 5/1989 Genovese et al. ..... 128/25
5,209,223 A * 5/1993 McGorry et al. ..... 128/25
5,244,441 A * 9/1993 Dempster et al. ..... 482/9
5,255,188 A * 10/1993 Telepko ..... 364/413
5,331,851 A * 7/1994 Parviainen et al. ..... 73/379
5,417,643 A * 5/1995 Taylor ..... 601/33
5,738,612 A * 4/1998 Tsuda ..... 482/8
6,432,061 B1 * 8/2002 Nissila et al. ..... 600/500

* cited by examiner

*Primary Examiner*—Nicholas D. Lucchesi
*Assistant Examiner*—L Amerson
(74) *Attorney, Agent, or Firm*—Duane Morris LLP; Robert E. Rosenthal

(57) ABSTRACT

A method for performing human isometric exercise includes the steps of sensing an applied force, providing a signal representing the applied force, receiving the signal and comparing the applied force to a preselected force, and providing the result of the comparison to a user in real time. The result of the comparison may be provided in an alphanumeric or other visible display, or by auditory means. The time that force is applied may be compared to a preselected time period, and a message provided to a user to rest when the preselected time period has been reached. The number of repetitions of the application of force during a session may be compared to a preselected number of repetitions, and an indication of session completion provided to a user when the number of completed repetitions equals the preselected number. A device for use in isometric exercise includes a device for sensing an applied force and providing an output signal representing the applied force, electronics for if receiving the signal and comparing the applied force to a preselected force, and providing the result of the comparison to a user.

20 Claims, 2 Drawing Sheets

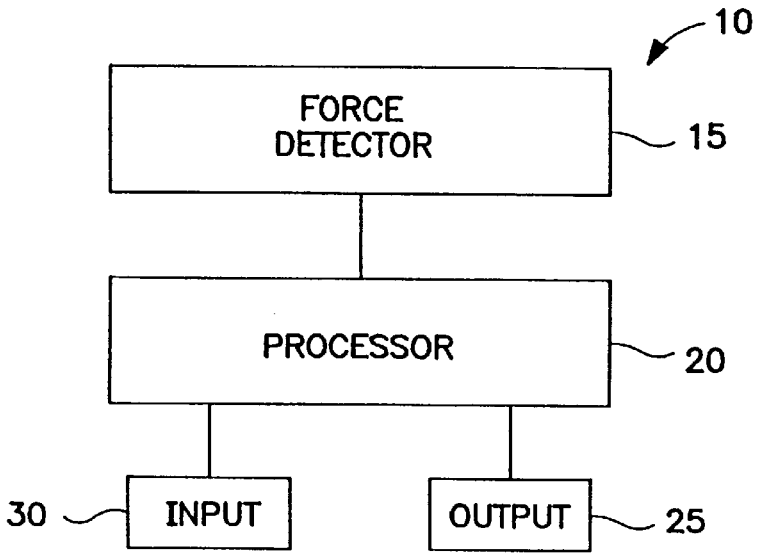
FIG. 1
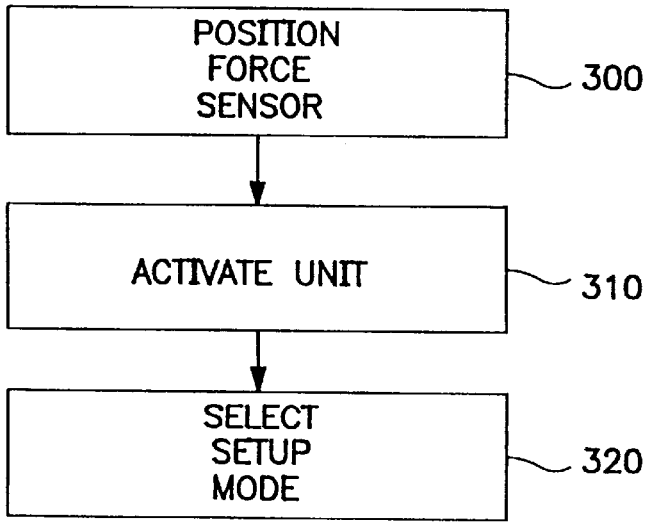
FIG. 3
FIG. 4
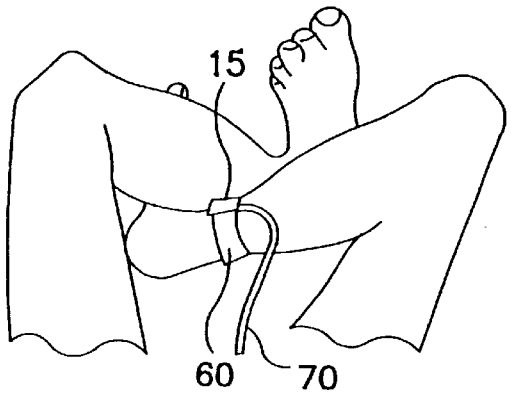

METHOD AND APPARATUS FOR ISOMETRIC EXERCISE

RELATED APPLICATIONS

This application is a divisional of copending application Ser. No. 09/589,702, filed Jun. 8, 2000, which claims priority from U.S. Provisional Patent Application No. 60/139,118, filed Jun. 14, 1999, and the entire disclosure of both of those applications is hereby incorporated by reference herein.

FIELD OF THE INVENTION

This invention relates to isometric exercise, and in particular to devices and methods for providing user feedback during isometric exercise.

BACKGROUND OF THE INVENTION

Isometric exercise is widely recommended and used for a variety of reasons. Isometric exercise is the application of a force against resistance with little or no motion. For example, in isometric exercise, an individual may apply pressure with a foot, hand or leg against another foot, hand or leg, or against a wall or other immobile object. One of the most widely applicable uses of isometric exercise is in the management of the disease of arthritis. Other uses of isometric exercise include rehabilitation after injuries and general muscle conditioning, after joint replacement, tendon or ligament injury.

In order to be effective, isometric exercise is preferably performed on a multiple time per week basis. A session of isometric exercise, to provide maximum benefit, generally includes exerting force within a particular range, by a particular muscle group, for a particular time period, over a particular number of repetitions. It is not practical for every individual who would benefit from frequent isometric exercise to be supervised by a physical therapist or trainer for each of these frequent exercise sessions. As a result, individuals must engage in isometric exercise often without supervision. With or without professional training, in practical experience, individuals who are instructed in isometric exercise and would benefit from such exercise, fail to follow the exercise routine at all, or do so incorrectly. Because of the known lack of compliance, many medical professionals hesitate to recommend isometric exercise even when it could be beneficial. As a result, isometric exercise is used much less frequently than would be desirable. The inventors believe that among the reasons for the failure of individuals to follow a routine of isometric exercise is the tedious nature of such exercise, particularly when performed on a solitary basis. Moreover, for isometric exercise to be most effective, the amount of force applied and the time the force is applied must be consistent. There is typically no way for the users to monitor the forces being applied, and therefore they cannot apply the proper amount of force for the specified time periods. Many individuals are also believed to experience difficulty in remembering such items as the required time periods for exertion and rest between exertions and numbers of repetitions. Additionally, isometric exercise can raise blood pressure if contraction is sustained too long. Compliance with the "BRIME" (brief resistive isometric exercise) is known not to raise blood pressure appreciably, and consists of six second contractions followed by 20 seconds of rest. Therefore control of contraction and rest time periods is desirable.

OBJECTS AND ADVANTAGES OF THE INVENTION

It is an object of the invention to provide an apparatus and method for use in isometric exercise that renders isometric exercise more pleasant and makes the user more compliant to the exercise.

It is also an object of the invention to provide such an apparatus and method for home use, under little or occasional therapeutic supervision.

It is a further object of the invention to provide an apparatus and method for use in isometric exercise that assists the user to determine whether the exercise is being conducted in accordance with instructions.

It is a further object of the invention to provide an apparatus for use in isometric exercise that is easy to operate.

It is a further object of the invention to provide a method for convenient setup and customization for individual users of an apparatus for assistance in the performance of isometric exercise.

Additional objects and advantages of the invention will become evident from the detailed description of a preferred embodiment which follows.

SUMMARY OF THE INVENTION

A method for performing isometric exercise comprises the steps of sensing an applied force, providing a signal representing the applied force, receiving the signal and comparing the applied force to a predetermined force, and displaying the result of the comparison to a user.

A device for use in isometric exercise includes a device for sensing an applied force and providing an output signal representing the applied force, electronics for receiving the signal and comparing the applied force to a predetermined force, and displaying the result of the comparison to a user.

A method for programming a device for use in isometric exercise by an individual user includes the step of storing in the device the values of desired target forces to be applied during isometric exercise. Other values may also be stored in the device.

BRIEF DESCRIPTION OF THE FIGURES

FIG. 1 is a schematic drawing of a device according to the invention.

FIG. 3 is a flow chart showing the setup steps of an exemplary device according to the invention.

FIG. 4 is an illustration of the placement of a force sensor in a device according to the invention.

DETAILED DESCRIPTION OF A PREFERRED EMBODIMENT

Figure 2:
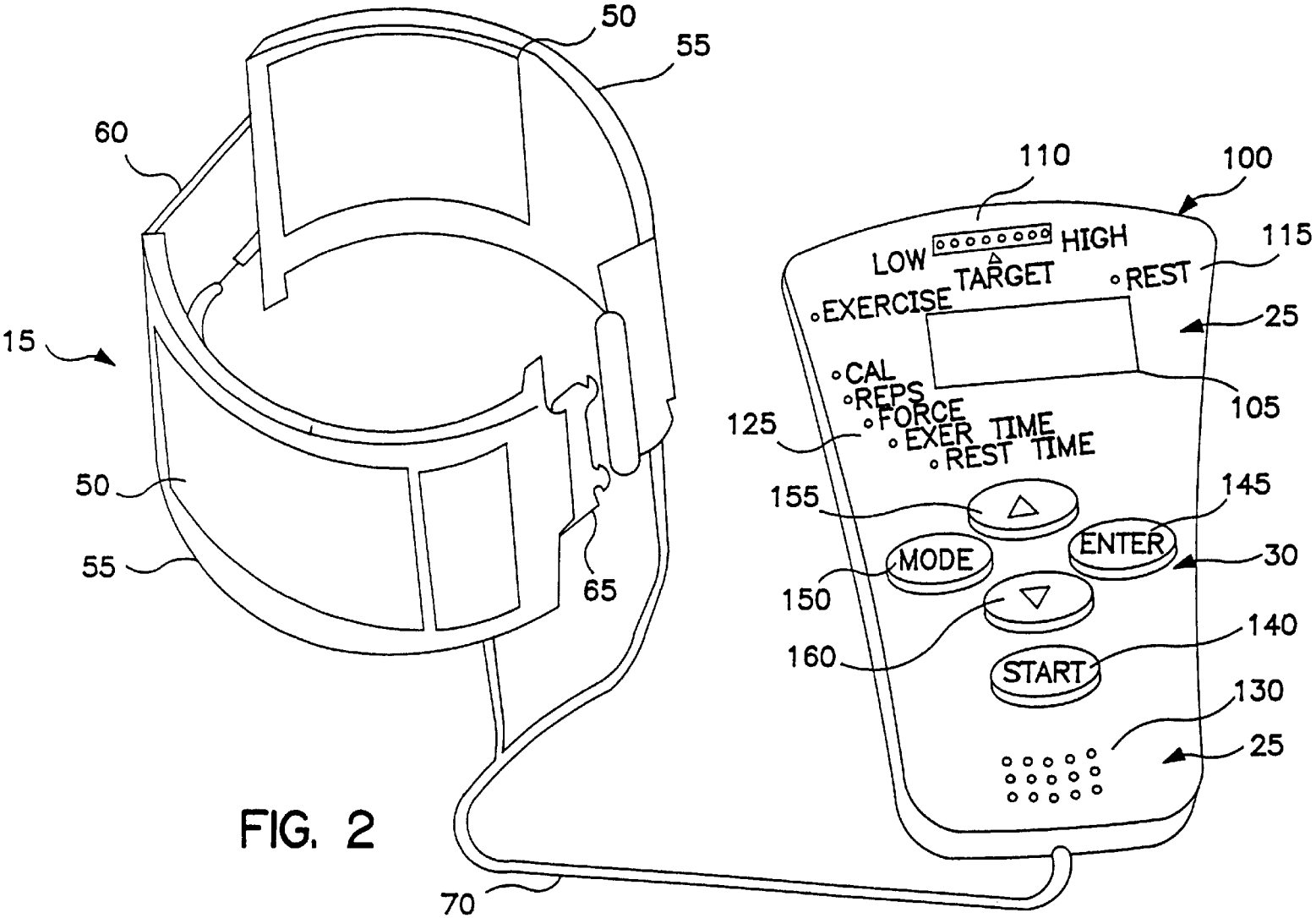
FIG. 2 is a representation of an exemplary device according to the invention.

Referring now to FIG. 1, there is shown a schematically a device 10 according to the invention for use in connection with isometric exercise. Device 10 includes force sensor cuff 15, electrically connected to processor 20, which is electrically connected to output 25. Force sensor cuff 15 may be any suitable force sensor. Examples of suitable force sensors include capacitive sensors, as described in more detail below, piezoresistive sensors, pneumatic sensors, hydraulic sensors, piezoelectric sensors, and strain gauges. Processor 20 may be any suitable combination of suitably programmed microprocessors, memory devices and other equipment, for implementation in software, firmware, or digital or analog circuits, for achieving the functions described below. The discussion below generally will employ the example of a processor using suitable software. Output devices may include visual, auditory, and/or tactile outputs, although visual outputs are described in greater detail below. Auditory outputs may include predetermined noises, or recorded or digitally reconstructed preselected verbal messages. Tactile messages may include vibrations of a handheld or body-mounted device. Processor 20 is also coupled to input 30. Input 30 is adapted to receive programming instructions and requested information from the user for transmission to the processor. Any desired input interface may be employed.

Referring to FIG. 2, a specific example of a device according to the invention is illustrated. In this embodiment, force sensor cuff 15 includes capacitive sensors 50 suitably mounted in housings 55 which incorporates required electrical connections between cable 70 and the conductive layers of capacitive sensor 50. Force sensor cuff 15 is adapted to be mounted on a limb of a human user by strap 60. Specifically, housings 55 are joined at adjacent ends by flexible, adjustable strap 60, and are releasably joined at opposite ends by buckle 65. Strap 60 is of a selected length to fit on a variety of diameters of limbs. For example, strap 60 may be sized to fit around typical sizes of ankles of adults. Strap 60 may be of any suitable woven or non-woven fabric.

Force sensor cuff 15 includes two sensors 50 in a configuration adapted for use in isometric exercise for strengthening the muscles of the knee. Having two sensors 50 is advantageous in that the user may strengthen the right hamstrings and left quadriceps, and then switch to strengthening the left hamstrings and right quadriceps without the need to reposition force sensor cuff 15. A cuff may be constructed with a single sensor 50. However, this will require the user to reposition the cuff when changing exercise positions.

Capacitive sensor 50 may include an open cell polyurethane foam dielectric sandwiched between two flexible conductor layers. In this example, two insulating end plates fully enclose the sandwiched layers. A three layer configuration includes two foam dielectric layers surrounded by and separated by conductor layers in alternating fashion. Two insulating end plates fully enclose the sandwiched layers. In essence, the sensor itself can be thought of as a variable capacitor, one element in a circuit such as an astable multivibrator circuit where the output square wave varies in frequency as the capacitance changes. This three conductor capacitive force sensor is substantially equivalent to the circuit representation of a capacitor. The capacitive sensor could also be one element in a circuit such as a continuously triggered monostable multivibrator circuit where the output square wave varies in duty cycle as the capacitance changes. This square wave may then be input into a low pass filter so as to make it a DC voltage.

Each sensor 50 of force sensor cuff 15 is electrically coupled, through electrical connections in cable 70, to exemplary handheld unit 100. It will be understood that alternatives may be employed for cable 70. For example, force sensor cuff 15 may include a transmitter, such as an infrared transmitter or sonic transmitter, and unit 100 incorporate a corresponding receiver. Unit 100 houses processor 20 (not shown in FIG. 2), audible and visual output 25 and input 30. Handheld unit 100 is an example of the type of input and output unit that may be used. In handheld unit 100, output 25 includes alphanumeric display 105 (which may be an LCD display), qualitative LED bar graph display 110, exercise/rest indicators 115 (which may be LEDs), operational mode indicators 125 (which may be LEDs), and audio speaker 130. Input devices 30 include various buttons for menu-driven operation of unit 100. The buttons illustrated are Start button 140, Enter button 145, Mode button 150, and Up and Down buttons 155 and 160 respectively. Handheld unit 100 may incorporate a suitable power supply, or may be adapted to be electrically connected to a suitable source of electrical power. Handheld unit 100 may incorporate an apparatus for imparting a vibration to handheld unit 100. Such an apparatus may include electric motors for imparting rotating motion to an eccentrically mounted body.

Referring now to FIG. 3, the initial setup of device 10 will be explained. Either independently or in the presence of suitably trained personnel, a user applies force sensor cuff 15 to a proper body location. Referring to FIG. 4, there is shown force sensor cuff 15 in position on an ankle of a user. Force sensor cuff 15 is maintained in a suitable position by strap 60. In FIG. 4, force sensor cuff 15 is suitably positioned to permit isometric exercise of leg muscles. Numerous alternative locations of force sensor cuff 15 are possible depending on the muscle in question. For example, force sensor cuff 15 may be applied around the upper arm of an individual and the individual may press against an immobile object like a wall to isometrically strengthen the muscles of the shoulder which are in need of rehabilitation.

As shown in FIG. 3, after positioning of the force sensor, the handheld unit is activated, as shown by the blocks marked POSITION FORCE SENSOR and ACTIVATE UNIT. The unit is placed in initial setup mode, as shown by the block marked SELECT SETUP MODE. In SETUP mode, the user is prompted to create a protocol for each session. The user may select the desired force to be applied, the number of repetitions during each session, the length of time force is to be applied, the length of time of each rest period, and any other desired information. LED indicators of display 125 may successively be activated to designate the particular item of information that is being set during the setup process. Selection of each of these items will cause processor 20 to store each of these items in a suitable location in a memory. The memory is preferably of the non-volatile type, to minimize power use during periods when unit 100 is not being employed by a user, although volatile memory with suitable battery power could be employed.

For example, the user may first select a desired target force. The user may select a single target force level, and suitable software may, using an appropriate algorithm, automatically select upper and lower limits of a force range. Alternatively, the user may be prompted to apply the maximum force achievable multiple times. The average force applied is determined via microcontroller 20. The target force is determined from an algorithm using the average force. For example, the target force may be 80% or a different percentage, of the average maximum force. This value can be stored in memory. The user may have the option of selecting the width of the force range; this range may be expressed as a percentage above and below the calculated value.

If the user wishes to engage in exercise of another muscle group upon completion of a session, the user may program the device in a suitable manner. Alphanumeric or recorded messages may be provided to prompt the user to reposition the force detector for exercise of these other muscle groups.

The unit may be programmed to provide for changes in parameters that affect the target force value and the upper and lower limits of the force range. For example, the user may change the width of the target force range and change the factor or algorithm for calculating the target force from a detected maximum force. The user may also adjust the number of repetitions, the length of time force is to be applied, or the length of the rest time between force exertions. Adjusting such values would be appropriate as the user gains strength or as proficiency with the device increases. As proficiency increases the range between the upper and lower limits of the force range can be decreased so the exercise becomes more precise.

In operation, the user positions force sensor cuff 15 appropriately depending upon the exercise. The handheld unit is then activated. It may be activated by pressing a power button (not shown) on the side of unit 100. Upon activation the device calibrates the force sensor by measuring its baseline force value. For automatic calibration of the device this baseline value is stored in memory and is subtracted from then on so as to display the proper force value. This is similar in respects to a tare button on an electronic scale. The user can then access all initial setup modes of unit 100 by pressing the MODE button 150 and displaying the stored value on the alphanumeric display 105 that has been stored from a prior session, or which may be a default value if unit 100 is being used for the first time. To change a value, the user presses the UP arrow button 155 or DOWN arrow button 160 until satisfied with the value. The user then presses the ENTER button 145 to store that value in memory. When fully satisfied that the initial setup procedure has been completed, the user presses the START button 140 to commence with the exercise. At this time, the alphanumeric display 105 may read "START" and an audible signal may be emitted from speaker 130.

The user then commences exercise. Unit 100 provides feedback in real-time on the extent to which the user is following the desired exercise protocol. Unit 100 may provide feedback as to whether or not the force applied is within the desired range as set during setup. For example, alphanumeric display 105 may provide a numerical indication of the force being applied. Indicator 110 may provide a qualitative indication as to whether the force being applied is correct, too low, or too great. Indicator 110 may be an LED bar graph that lights up according to how close to the desired target force the user is applying. If too low, the left most diodes are lighted; if the target force is being applied, all of the diodes to the left of the center diode are lighted. As the force applied exceeds the target force and increases further, more and more diodes to the right of center are lighted. Alternatively a single diode may be lighted and appear to sweep from left to right of the LED bar graph according to how close to the desired target force the detected force is. Other types of qualitative visual indicators of the force applied may also be employed. An auditory indication of the force may alternatively or also be provided from speaker 130. For example, different frequency tones may be emitted depending upon how close to the target force the user is, and whether the applied force is greater than or less than the target force. Alternatively, a verbal indication of the qualitative nature of the force may be provided. For example, the phrase "NOT HARD ENOUGH" may be used. Commands, such as "PUSH HARDER," or other encouragement may also be provided. Information as to whether the correct force is being applied may also be furnished to the user by movement or vibration of unit 100. Unit 100 may vibrate at a first frequency when too little force is being applied, at a second frequency when too great a force is being applied, and at a third frequency when a force sufficiently close to the target force is being applied. Any other suitable method may be used to communicate to the user whether the applied force is too low, too high, or sufficiently close to the target force.

Unit 100 also communicates to the user when the force has been applied for a sufficiently long time, and when the rest period between exertions has been sufficiently long. For example, processor 20 may at intervals compare the length of time elapsed since the commencement of the application of force to a time previously set. When the length of time elapsed since the commencement of the application of force is equal to or greater than the desired length of time for the application of force, unit 100 provides an indication to the user to rest. For example, display 25 may provide an indication of a rest period. The word "REST" may be displayed on alphanumeric display 105. A light may be illuminated next to the word "REST", and/or an instruction to rest may be verbally provided by speaker 130. Handheld unit 100 may be caused to vibrate in a predetermined manner to communicate to the user the commencement of a rest period.

Unit 100 then communicates to the user the time of commencement of the next force exertion repetition. For example, the time elapsed from commencement of the rest period may be compared at intervals during the rest period to a predetermined rest period length selected during setup. When the time elapsed from the commencement of the rest time is equal to or greater than the predetermined rest time, unit 100 communicates to the user to resume exercise. The displays and/or auditory indications are provided as before, and the process repeats itself. Unit 100 also provides an indication to the user when the number of repetitions selected during initial setup has been completed. For example, a memory location may be designated for the current number of repetitions. The number in this location may be incremented after each repetition, and compared to the preselected number of repetitions. Alternatively, processor 20 may store in a memory location the total elapsed time since the commencement of exercise. Either or both values are compared to a value selected during setup. When the value of the number of repetitions or the value of the total elapsed time is equal to or greater than the preselected value, the unit may notify the user that the session is at an end. If the user is to exercise other muscle groups, the unit notifies the user of this, by, for example, displaying an appropriate alphanumeric message. For example, the display may read "SWITCH LEGS." The process then repeats for each other muscle group. When all exercise is completed, the user is prompted to deactivate the unit. Alternatively, the unit could turn itself off if there is no activity after a prescribed period of time.

The forces actually detected, times of force application and rest, and other detected information may be stored in suitable memory locations. This information may be reviewed on the unit, or downloaded through a suitable interface, for review by medical professionals. This provides a review of the actual course of exercise which is not dependent on the powers of observation and recall of the users. Handheld unit 100 may include a data port, or similar device, for transmission of data to communications devices. For example, a user may periodically bring the handheld unit 100 to a therapist's office for downloading of data to a compatible device. Handheld unit 100 may also be provided with an output that is compatible with an input of a user's personal computer. Data from the handheld unit can be transferred and saved in a file in the user's personal computer, and then transmitted, via the Internet or a dial-in connection, for example, to a therapist's or physician's computer system for review. Alternatively, handheld unit 100 could be equipped with a modem to dial in to a therapists's or physician's computer system.

It will be understood that the foregoing method and apparatus provides numerous advantages over conventional methods of performing isometric exercise. The user can observe with immediate feedback whether the amount of force applied is proper, and can immediately adjust the amount of force applied to fall within a desired range. The user is also provided with immediate feedback that a session has been completed, with no doubt as to whether the number of repetitions of exertion or the length of time of the exertions is correct. This immediate feedback is believed by the inventors to provide significant motivation and to keep users of the device diligent in performing isometric exercise protocols. The method and device of the invention permits the user to apply the proper amount of force, for the proper period of time, and the correct number of repetitions, during each exercise session. The user is not required to use a timer or stopwatch, and will not risk losing track of the time the force is applied, the rest time, or the number of repetitions. The user is led through a consistent workout, which is easier to comply with. There is no risk of loss of printed exercise instructions.

While the methods and apparatus of the invention have been described with respect to a particular embodiment, variations within the spirit of the invention will be apparent to those of skill in the art, and the invention should not be regarded as limited to a particular embodiment.

What is claimed is:

1. A method for providing information about the performance of isometric exorcise, comprising the steps of:

detecting a force applied during isometric exorcise to a force sensor in a cuff positioned on a limb of a user, comparing the detected force to a preselected force range, and communicating the result of the comparison to a user in real time.

2. The method of claim 1 further comprising the steps of measuring the amount of time the force has been applied, comparing the measured amount of time to a preselected duration, and notifying the user to rest when the measured amount of time is equal to or greater than the preselected duration.

3. The method of claim 1, further comprising the steps of measuring the amount of time elapsed following the commencement of a rest period, comparing the time elapsed to a preselected rest period length, and notifying the user to resume when the preselected rest period length has elapsed.

4. The method of claim 1, wherein said step of communicating comprises providing a low force indication if an applied force is less than a preselected force range, providing a correct force indication if an applied force is within the preselected force range, and providing a high force indication if an applied force is in excess of the preselected force range.

5. The method of claim 1, further comprising the step of monitoring the number of repetitions of an exercise, comparing the detected number to a preselected number of exercises, and notifying the user to change positions when the detected number of exercises is equal to the preselected number.

6. A method of preparing a device for use in isometric exercise for an individual user, comprising the steps of detecting at a force sensor in a cuff positioned on a limb of a user a force applied by a user, selecting based on the detected force a target force value to be applied during isometric exercise and storing in the device the selected target force value.

7. The method of claim 6, wherein said step of selecting comprises manually entering said target force value in a hand held unit.

8. The method of claim 6, wherein the method of selecting comprises detecting a maximum force value applied by the user, and calculating the target force value based on predetermined parameters and the detected maximum force value.

9. The method of claim 6, further comprising the step of selecting the width of a range of acceptable forces around the selected target force value.

10. The method of claim 6, further comprising the step of storing in the device a predetermined length of time for application of force during one repetition or exertion.

11. The method of claim 6, further comprising the step of storing in the device a period of time for a rest time between exertions.

12. The method of claim 6, further comprising the step of storing in the device a preselected number of repetitions of exertion.

13. The method of claim 1, wherein said step of detecting comprises employing a capacitive force sensor.

14. The method of claim 13, wherein said capacitive force sensor comprises a dielectric of open cell foam polyurethane.

15. The method of claim 1, wherein said step of communicating comprises communicating from a hand held unit.

16. The method of claim 15, wherein said step of communicating from a hand held unit comprises providing a visible display on said hand held unit.

17. The method of claim 15, wherein said step of communicating from a hand held unit comprises providing an audible signal from said hand held unit.

18. The method of claim 6, wherein said target force value is stored in a hand held unit.

19. The method of claim 1, wherein said cuff is supported by and freely movable with said limb.

20. The method of claim 6, wherein said cuff is supported by and freely movable with said limb.

* * * * *

UNITED STATES PATENT AND TRADEMARK OFFICE

CERTIFICATE OF CORRECTION

PATENT NO. : 6,595,901 B2 
DATED : July 22, 2003
INVENTOR(S) : Kirk A. Reinbold and Robert J. Goldman It is certified that error appears in the above-identified patent and that said Letters Patent is hereby corrected as shown below:

Column 1,
Line 10, after the "RELATED APPLICATIONS" paragraph, insert the following:

-- STATEMENT REGARDING FEDERALLY SPONSORED RESEARCH OR DEVELOPMENT

This invention was made with government support under Grant #1-R43-AR45153-01 awarded by the National Institutes of Health. The government has certain rights in this invention. --

Signed and Sealed this

Second Day of November, 2004

JON W. DUDAS
*Director of the United States Patent and Trademark Office*